US007178517B1

(12) United States Patent
Yu

(10) Patent No.: US 7,178,517 B1
(45) Date of Patent: Feb. 20, 2007

(54) DIAMOND SAW BLADE FOR MILLING

(76) Inventor: Fang-Chun Yu, 18, Alley 123, Lane 668, Ying Tao Road, Ying Ko Town, Taipei County (TW)

( * ) Notice: Subject to any disclaimer, the term of this patent is extended or adjusted under 35 U.S.C. 154(b) by 0 days.

(21) Appl. No.: 11/342,801

(22) Filed: Jan. 31, 2006

(51) Int. Cl.
*B28D 1/06* (2006.01)

(52) U.S. Cl. ..... 125/13.01; 125/15; 125/22

(58) Field of Classification Search ..... 125/15, 125/22, 13.01
See application file for complete search history.

(56) References Cited

U.S. PATENT DOCUMENTS

| | | | | | |
|---|---|---|---|---|---|
| 626,533 | A * | 6/1899 | Forster | 125/22 |
| 1,866,356 | A * | 7/1932 | Jones | 125/22 |
| 1,908,107 | A * | 5/1933 | Bley | 125/22 |
| 1,919,352 | A * | 7/1933 | Albright | 125/22 |
| 2,073,678 | A * | 3/1937 | Broughton | 125/15 |
| 2,508,042 | A * | 5/1950 | Rehnberg | 51/309 |
| 3,371,452 | A * | 3/1968 | Mabey | 451/541 |
| 3,553,905 | A * | 1/1971 | Lemelson | 451/541 |
| 4,407,263 | A * | 10/1983 | Murata | 125/15 |
| 4,547,998 | A * | 10/1985 | Kajiyama | 451/541 |
| 5,406,929 | A * | 4/1995 | Udert et al. | 125/15 |
| 5,544,643 | A * | 8/1996 | Bauer et al. | 125/12 |
| 6,039,641 | A * | 3/2000 | Sung | 451/540 |
| 6,098,609 | A * | 8/2000 | Ishizuka | 125/13.01 |
| 6,561,177 | B2 * | 5/2003 | Ball | 125/13.01 |
| 6,609,965 | B2 * | 8/2003 | Fujioka | 451/547 |
| 6,626,167 | B2 * | 9/2003 | Kim et al. | 125/15 |
| 6,932,076 | B2 * | 8/2005 | Liao et al. | 121/15 |

* cited by examiner

*Primary Examiner*—M. Rachuba
(74) *Attorney, Agent, or Firm*—Rosenberg, Klein & Lee

(57) ABSTRACT

The present invention relates to a diamond saw blade for milling. The rim of the circular metal with a shaft or the front end of the tubular body or an edge of the strip metal has multiple equidistant openings for positioning the diamond grains. The width of the opening is slightly wider or equal to the diameter of the diamond grain. After the diamond grains are positioned in each opening, the metal surface on both sides of each opening is pressed by the jig through two directions. The metal surface on both sides of the opening is deformed by the pressure from the jig, and extrudes along the direction of each opening for bonding diamond grains. Further, the surface forms a rugged cutting edge. More, a diamond layer with diamond grains is electroplated on the surface of the cutting edge. It, therefore, has a long lifecycle and becomes a high-speed cutting edge for milling without deformation.

2 Claims, 5 Drawing Sheets

DIAMOND SAW BLADE FOR MILLING

BACKGROUND OF THE INVENTION

1. Field of the Invention

The present invention relates to a diamond saw blade for milling. More particularly, the present invention improves the cutting edge of the saw blade for the diamond milling.

2. Description of the Related Art

Conventionally, the diamond saw blade uses the softer and circular metal material under a mechanical rolling or a mechanical rolling through high temperature to bond the diamond grain and the rim of the annular copper body for its formation. The structure in the present invention has a well cutting performance. However, since the diamond saw blade is made of copper or other softer metal, the copper has less strength only for slow cutting. Therefore, it is easy to get deformed and damaged under high-speed cutting. Please refer to FIGS. 1 and 1A. Figures are 3-D diagrams of the prior arts showing the diamond saw blade and the diamond drill bit used by the electroplated method to bond diamond grains. The cutting edge (10*a* and 11*a*) uses circular or tubular metal material with electroplated method implemented. Moreover, the electroplated layer is increased, and the diamond grains bond to the cutting edge (10*a* and 11*a*) for forming a diamond saw blade and a diamond drill bit. The cutting edge portion is only covered with a layer of diamond grains through electroplating for milling and cutting. This, therefore, is easy to get damaged and decreases the lifecycle for milling.

FIG. 2 is another 3-D diagram of the prior art showing the diamond saw blade used by the rolling method to bond diamond grains. The rim of the circular metal plate has multiple inclined trenches (12*a*) for positioning diamond grains. Further, one stacks with the other for rolling the rim by the roller (13). The inclined trench (12*a*) is pressed and closely bonded with diamond grains for forming a diamond saw blade (12). The diamond saw blade based on the above structure was already used on precious gems before 1970. However, it does not have a long lifecycle for cutting. In order to overcome the above shortcomings, the industry developed (as shown in FIG. 3) a diamond saw blade (14) used by metal sintering. Different metal powders and diamond grains are mixed together, and then positioned on a specified jig under high temperature (650° C.~1500° C.) and high pressure for forming a diamond grinding wheel (14*a*). Further, each diamond grinding wheel (14*a*) is welded to the rim of the circular steel (14*b*) with a shaft for forming a diamond saw blade (14). However, the above diamond saw blade (14) by metal sintering requires high-cost diamond grains and different kinds of metal powders for the manufacture. Besides, the manufacture of the mixture between diamond grains and metal powders will cause skin lesions to the operator. Further, the external accessories for the manufacture are extremely expensive Moreover, it requires more electrical energy thereto causing air pollution. Sometimes, the cost for manufacturing the diamond saw blade is several times more than the one used by mechanical rolling or general electroplating. Therefore, it can not meet the low cost for different industries. Further, the diamond saw blade (14) used by metal sintering (as shown in FIG. 3) has some advantages, such as no deformation on the body. However, its cutting performance is worse than the copper diamond saw blade which is used by mechanical rolling. From the above descriptions, the advantages of the mechanical rolling method and electroplated method are low manufacture cost, high cutting performance, and easy manufacture. However, the strength is insufficient as its disadvantage. The diamond saw blade (14) with metal sintering uses steel as its main body, and has better strength so it does not get deformed. However, the disadvantages are poor cutting performance, and high manufacture cost.

According to the mentioned descriptions, the above manufacture methods should be improved. The present invention, therefore, is proposed to overcome the mentioned shortcomings, such as decreasing the cost, simplifying the manufacture, and increasing the sharpness without scarifying the merits of each manufacture.

Further, the invention has a better structure, and the performance is also improved. The structure in the present invention, therefore, possesses a high cutting performance and a long lifecycle. The structure, purpose, method and spirit of the invention can refer to the following detailed description of the preferred embodiments taken in conjunction with the accompanying drawings.

SUMMARY OF THE INVENTION

The present invention relates to a saw blade for diamond milling. Please refer to FIG. 4 and FIG. 5. The rim of the circular metal (20) with a shaft or the front end of the tubular body (30) or an edge of strip metal has multiple equidistant openings (20*a* and 30*a*) for positioning the diamond grains (40). The width of the opening (20*a* and 30*a*) is slightly wider or equal to the diameter of the diamond grain (40). After the diamond grains are positioned in each opening (20*a* and 30*a*), the metal surface on both sides of each opening is pressed by the jig in two directions. As seen in FIG. 6 and FIG. 8, the metal surface on both sides of the opening is deformed by the pressure from the jig, and extrudes along the direction (as shown in FIG. 6A) of each opening (20*a* and 30*a*) for bonding diamond grains (40). Please refer to FIGS. 6, 8, and 6A. The surface forms a rugged cutting edge (201 and 301). Moreover, a diamond layer (401) with diamond grains is electroplated on the surface of the cutting edge (201 and 301) for forming a cutting edge (201 and 301) with long lifecycle and high cutting performance but no deformation, please refer to FIGS. 7, 7A and 9. Further, the electroplated diamond layer (401) of the cutting edge (201 and 301) and the bonding diamond grains (40) of each opening (20*a* and 30*a*) form the diamond saw blade (2) and the diamond drill bit (3) with a long lifecycle and high-speed cutting performance.

DETAILED DESCRIPTION OF THE PREFERRED EMBODIMENT

Figure 1A:
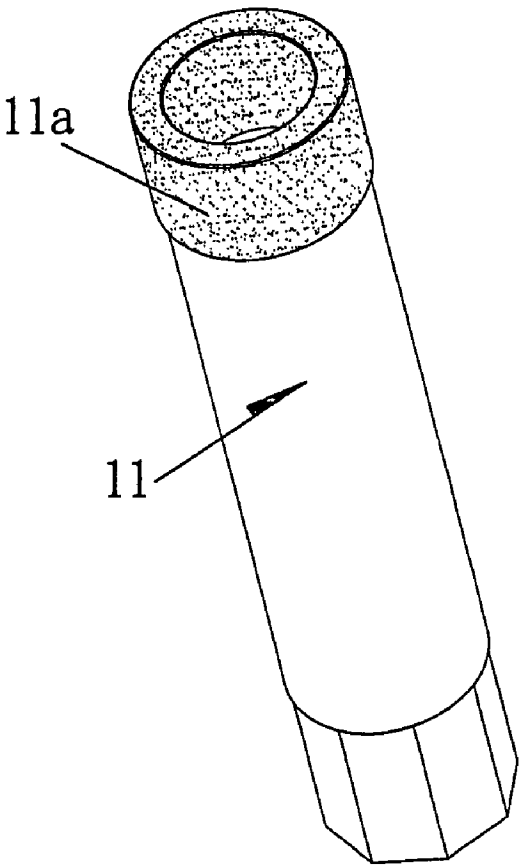
FIG.1A PRIOR ART
FIG. 1A is a 3-D diagram of the prior art showing the diamond drill bit used by the electroplated method to bond diamond grains.
Figure 1:
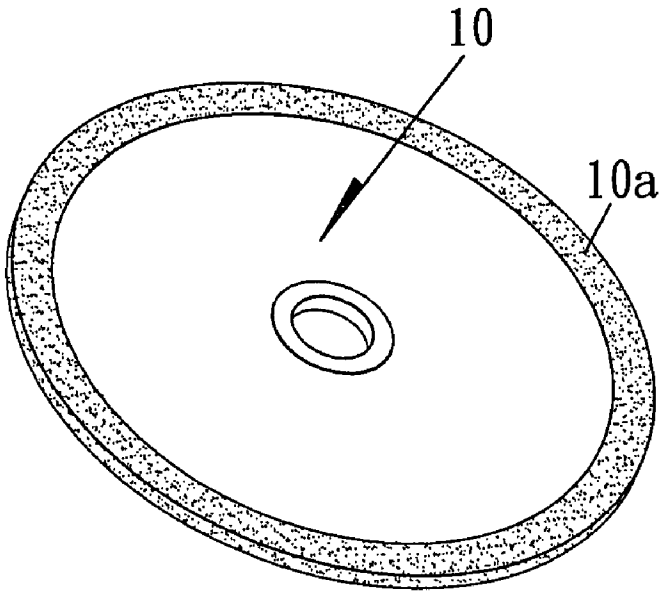
FIG.1 PRIOR ART
FIG. 1 is a 3-D diagram of the prior art showing the diamond saw blade used by the electroplated method to bond diamond grains.
Figure 3:
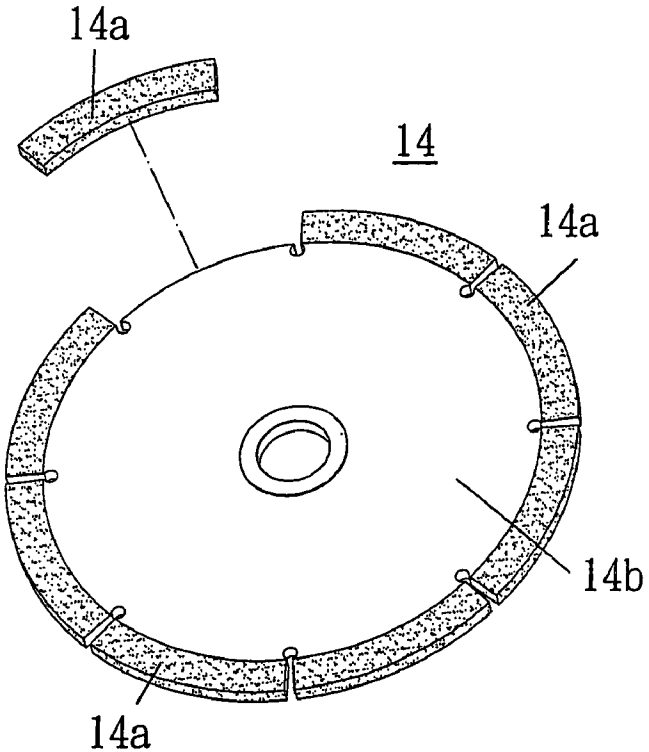
FIG .3 PRIOR ART
FIG. 3 is a 3-D diagram of the prior art showing the diamond saw blade used by metal sintering.
Figure 2:
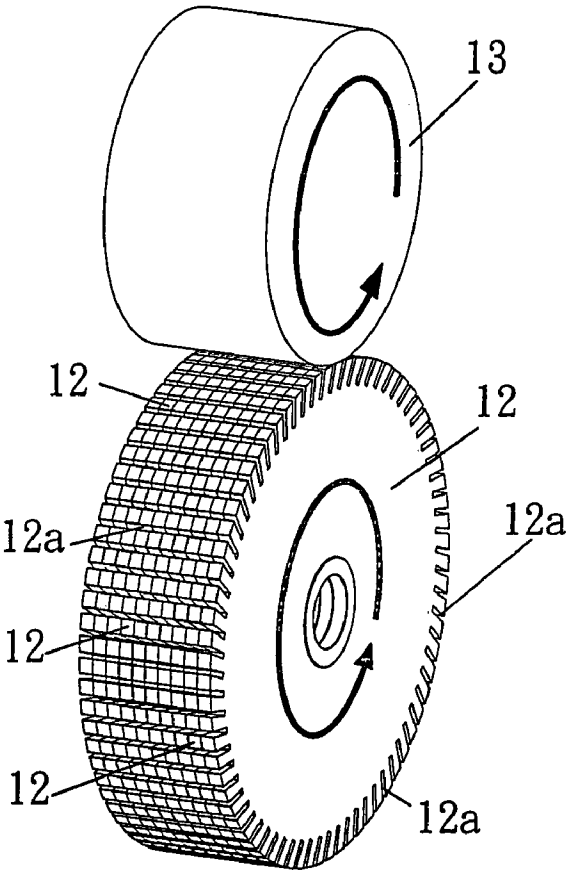
FIG .2 PRIOR ART
FIG. 2 is a 3-D diagram of the prior art showing the diamond saw blade used by the rolling method to bond diamond grains.
Figure 5:
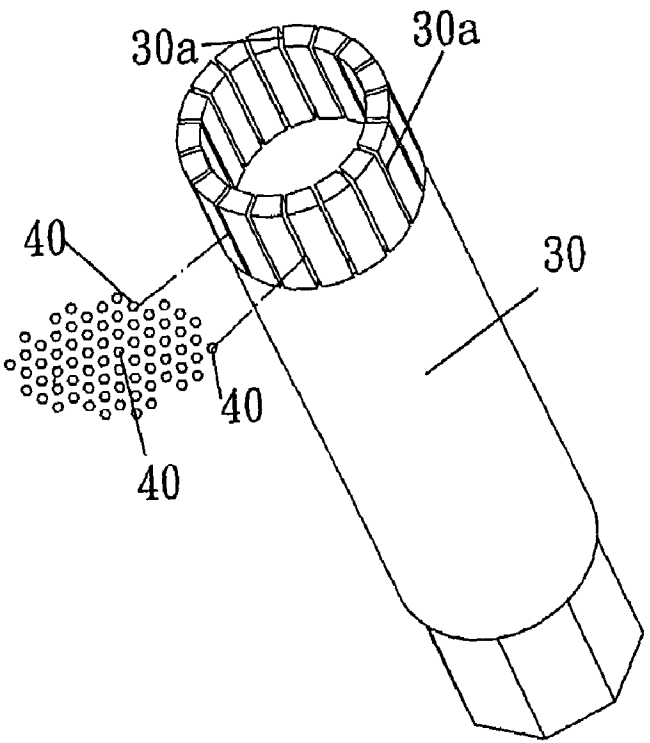
FIG. 5 is a schematic view of the present invention showing the front end of the tubular metal body having multiple equidistant openings for positioning diamond grains.
Figure 4:
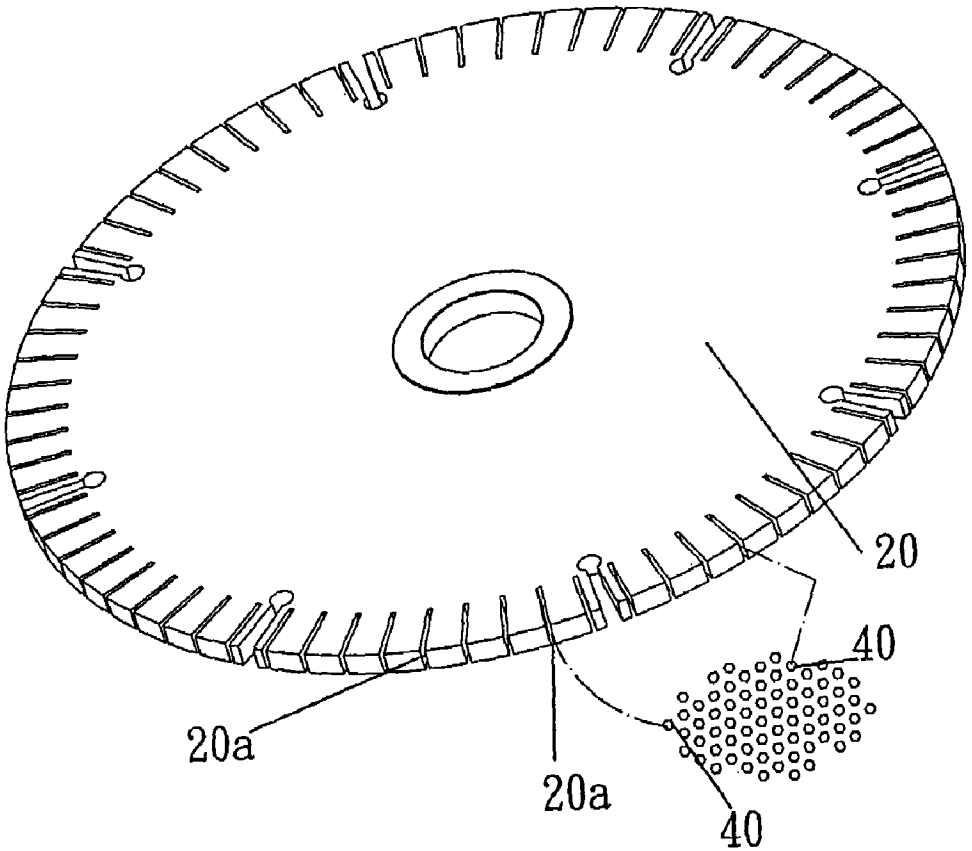
FIG. 4 is a schematic view of the present invention showing the rim of the circular metal having multiple equidistant openings for positioning diamond grains.
Figure 6A:
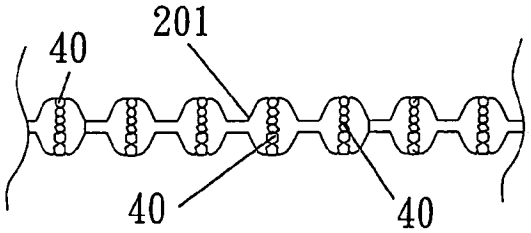
FIG. 6A is a partially cross-sectional view showing the circular metal opening having diamond grains with bonding through jig pressure for forming a rugged cutting edge.
Figure 7A:
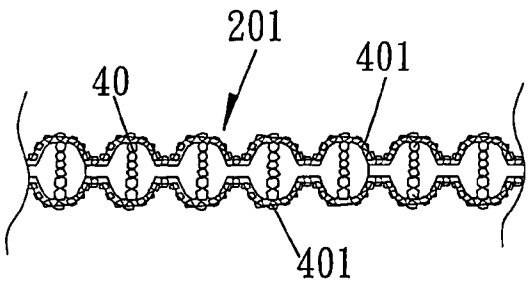
FIG. 7A is a partially cross-sectional view of the present invention showing the cutting edge of the diamond saw blade.
Figure 6:
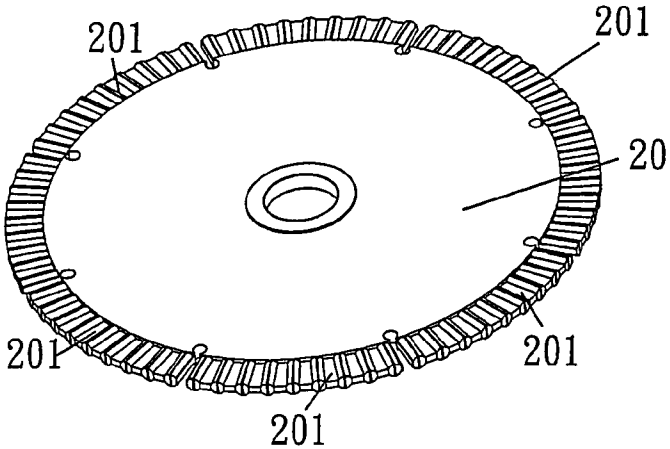
FIG. 6 is a 3-D diagram of the present invention showing the circular metal opening having diamond grains with bonding through jig pressure for forming a rugged cutting edge.
Figure 7:
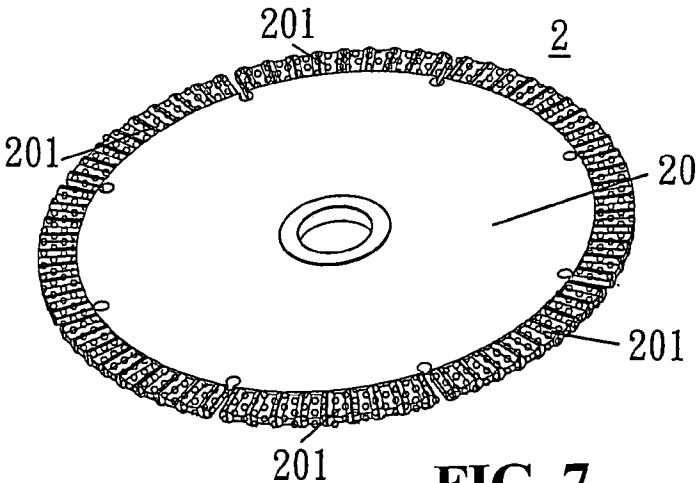
FIG. 7 is a 3-D diagram of the present invention showing the diamond saw blade.
Figure 9:
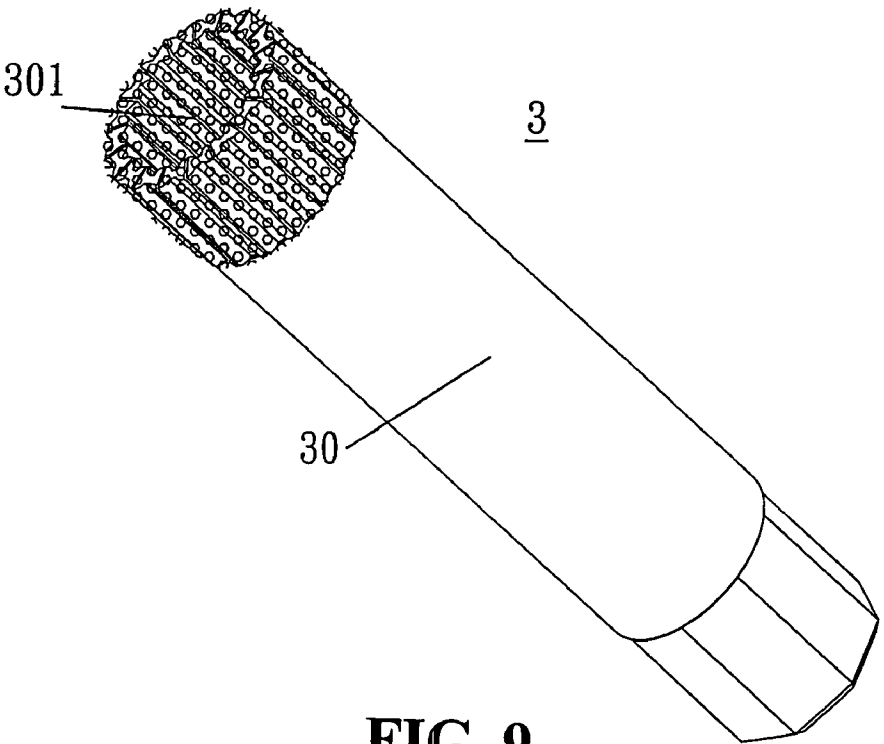
FIG. 9 is a 3-D diagram of the present invention showing the diamond drill bit.
Figure 8:
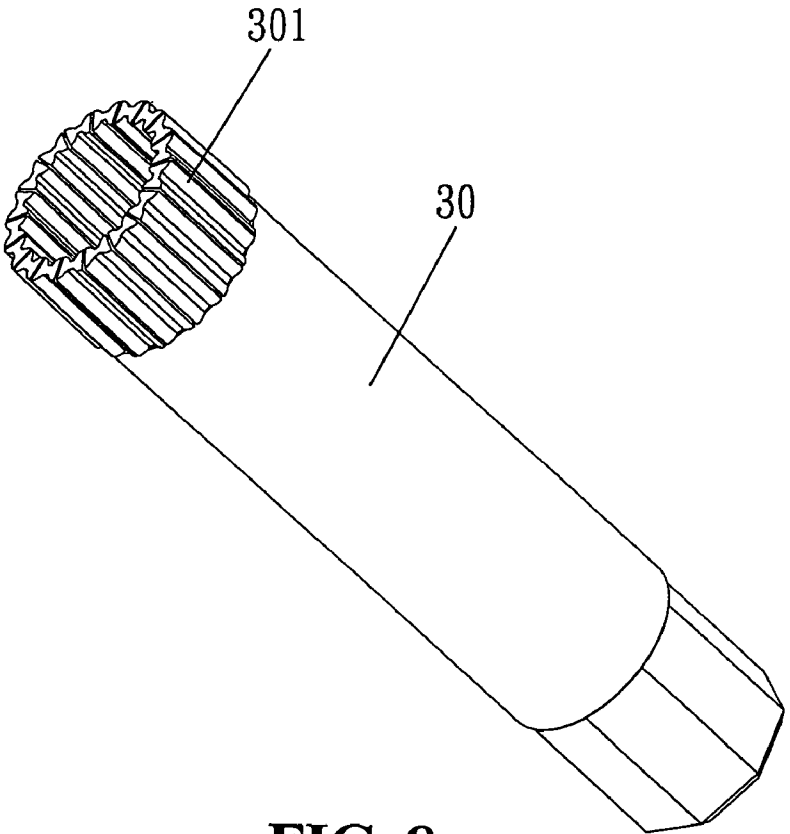
FIG. 8 is a 3-D diagram of the present invention showing the tubular metal opening having diamond grains with bonding through jig pressure for forming a rugged cutting edge.

Referring to FIGS. 4~9, the thickness of the electroplated diamond layer (401) in the cutting edge (201 and 301) can vary according to different purposes. Further, the electroplated metal of the electroplated layer can fill into the opening (20*a* and 30*a*) as well as load into the gap of the diamond grains. Moreover, it can increase the bonding of the diamond grains (40).

As can be seen from the present invention, it can increase the lifecycle and sharpness. The structure of the present invention is simple, and has not been published. All descriptions meet the requirements of patentability, such as utility, and novelty. The applicant follows the legal rules to apply the patent, and sincerely expects the examiner can exam the invention promptly and grants the patent right for the present application.

While the invention has been described by way of example and in terms of a preferred embodiment, it is intended to cover various modifications and similar arrangements and procedures. The scope of the appended claims therefore should be accorded the broadest interpretation so as to encompass all such modifications and similar arrangements and procedures.

What is claimed is:

1. A diamond saw blade or drill bit having an improved cutting edge, comprising: a circular metal blade with a shaft opening or a front end of a tubular drill bit body having a rim with multiple equidistant openings into which a plurality of diamond grains are positioned; wherein a width of said openings is wider or equal to a diameter of a respective diamond grain; wherein the metal surface on both sides of the opening pressed by the jig in two directions after the diamond grains are positioned in the opening, the diamond grains being bonded by jig pressure for forming a rugged cutting edge; wherein a diamond layer is bonded on the cutting edge with an electroplated metal, the diamond layer of the cutting edge and the diamond grains of the openings forming the diamond saw blade or diamond drill bit with long lifecycle and high-speed performance.

2. The diamond saw blade of claim 1, wherein the electroplated metal of said diamond layer fills into the openings as well as into gaps of the diamond grains for increasing a bonding of the diamond grains.

* * * * *